US010655511B2

(12) United States Patent
Son et al.

(10) Patent No.: US 10,655,511 B2
(45) Date of Patent: May 19, 2020

(54) CONTINUOUS VARIABLE VALVE DURATION APPARATUS AND ENGINE PROVIDED WITH THE SAME

(71) Applicants: Hyundai Motor Company, Seoul (KR); Kia Motors Corporation, Seoul (KR)

(72) Inventors: You Sang Son, Gyeonggi-do (KR); Ingee Suh, Gyeonggi-do (KR); Kiyoung Kwon, Gyeonggi-do (KR); In Sang Ryu, Incheon (KR); Kyoung Pyo Ha, Gyeonggi-do (KR); Dongheon Park, Seongnam-Gyeonggi-do (KR); Wootae Kim, Gyeonggi-do (KR); Back Sik Kim, Gyeonggi-do (KR); Seung Jae Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/172,595

(22) Filed: Oct. 26, 2018

(65) Prior Publication Data

US 2019/0178115 A1 Jun. 13, 2019

(30) Foreign Application Priority Data

Dec. 12, 2017 (KR) ..... 10-2017-0170389

(51) Int. Cl.
*F01L 13/00* (2006.01)
*F01L 1/053* (2006.01)
(Continued)

(52) U.S. Cl.
CPC ..... *F01L 13/0026* (2013.01); *F01L 1/053* (2013.01); *F01L 1/267* (2013.01); *F01L 13/0015* (2013.01);
(Continued)

(58) Field of Classification Search
CPC ..... F01L 1/047; F01L 1/356; F01L 1/34413; F01L 2013/0084; F01L 2013/0026;
(Continued)

(56) References Cited

U.S. PATENT DOCUMENTS

2006/0037578 A1* 2/2006 Nakamura ..... F01L 1/185 123/198 F
2009/0007862 A1* 1/2009 Nakamura ..... F01L 1/3442 123/90.12

(Continued)

*Primary Examiner* — Devon C Kramer
*Assistant Examiner* — Kelsey L Stanek
(74) *Attorney, Agent, or Firm* — Mintz Levin Cohn Ferris Glovsky and Popeo, P.C.; Peter F. Corless

(57) ABSTRACT

A continuous variable valve duration apparatus is provided. The apparatus includes a camshaft and a cam unit on which a cam is formed. The camshaft is inserted into the cam unit. An inner wheel transmits rotation of the camshaft to the cam unit. The inner wheel is rotatably inserted in a wheel housing a housing hinge aperture parallel to the camshaft is formed on the wheel housing. A slider hinge aperture and a slider control aperture parallel to the camshaft are formed through a slider. A hinge shaft is inserted into the housing hinge aperture and the slider hinge aperture. An eccentric cam is formed on a control shaft and is inserted into the slider control aperture. A controller selectively rotates the control shaft to move the wheel housing perpendicular to the camshaft via the slider.

17 Claims, 19 Drawing Sheets

(51) Int. Cl.
*F01L 1/26* (2006.01)
*F01L 1/047* (2006.01)

(52) U.S. Cl.
CPC ..... *F01L 2001/0476* (2013.01); *F01L 2001/0535* (2013.01); *F01L 2001/0537* (2013.01); *F01L 2013/103* (2013.01); *F01L 2105/02* (2013.01)

(58) Field of Classification Search
CPC ... F01L 1/053; F01L 1/267; F01L 2001/0535; F01L 2105/02
USPC ..... 123/90.16, 90.18, 90.27, 90.31
See application file for complete search history.

(56) References Cited

U.S. PATENT DOCUMENTS

2012/0266833 A1* 10/2012 Nakamura ..... F01L 1/3442 123/90.15
2016/0160697 A1* 6/2016 Son ..... F01L 1/356 123/90.16
2016/0160704 A1* 6/2016 Son ..... F01L 13/0015 123/90.15

* cited by examiner

CONTINUOUS VARIABLE VALVE DURATION APPARATUS AND ENGINE PROVIDED WITH THE SAME

CROSS-REFERENCE TO RELATED APPLICATION

This application claims priority to and the benefit of Korean Patent Application No. 10-2017-0170389 filed on Dec. 12, 2017, the entire contents of which are incorporated herein by reference.

BACKGROUND

(a) Field of the Invention

The present invention relates to a continuous variable valve duration apparatus and an engine provided with the same, and more particularly, to a continuous variable valve duration apparatus an engine provided with the same that varies an opening duration of a valve based on operation conditions of an engine.

(b) Description of the Related Art

An internal combustion engine generates power by burning fuel in a combustion chamber with air drawn into the chamber. Intake valves are operated by a camshaft to intake the air, and the air is drawn or suctioned into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. In other words, an optimal lift or optimal opening/closing timing of the valves depends on the rotation speed of the engine. To achieve such optimal valve operation based on the rotation speed of the engine, research has been conducted include the design of a plurality of cams and a continuous variable valve lift (CVVL) capable of changing valve lift based on engine speed. Additionally, to achieve such an optimal valve operation based on the rotation speed of the engine, research has been conducted regarding a continuously variable valve timing (CVVT) apparatus that enables different valve timing operations based on the engine speed. The general CVVT may change valve timing with a fixed valve opening duration. However, the general CVVL and CVVT are complex in construction and are expensive in manufacturing cost.

The above information disclosed in this section is merely for enhancement of understanding of the background of the invention and therefore it may contain information that does not form the prior art that is already known in this country to a person of ordinary skill in the art.

SUMMARY

Various aspects of the present invention provide a continuous variable valve duration apparatus and an engine provided with the same which may vary opening duration of a valve based on operation conditions of an engine, with a simplified construction.

A continuous variable valve duration apparatus according to an exemplary embodiment of the present invention may include a camshaft, a cam unit on which a cam is formed and of which the camshaft is inserted thereto, an inner wheel configured to transmit rotation of the camshaft to the cam unit, a wheel housing in which the inner wheel is rotatably inserted and on which a housing hinge aperture parallel to the camshaft is formed, a slider on which a slider hinge aperture and a slider control aperture parallel to the camshaft are formed, a hinge shaft inserted into the housing hinge aperture and the slider hinge aperture, a control shaft on which an eccentric cam inserted into the slider control aperture is formed and a controller configured to selectively rotate the control shaft to move the wheel housing perpendicular to the camshaft via the slider.

A guide aperture may be formed on the wheel housing perpendicular to the camshaft, and the continuous variable valve duration apparatus may further include a guide portion that has a guide shaft inserted into the guide aperture for guiding movement of the wheel housing. The guide portion may further include a guide bracket that supports the guide shaft. A first sliding aperture and a second sliding aperture may be formed the inner wheel respectively and a cam slot may be formed on the cam unit. The continuous variable valve duration apparatus may further include a roller wheel connected to the camshaft and rotatably inserted into the first sliding aperture and a roller cam slidably inserted into the cam slot and rotatably inserted into the second sliding aperture.

The roller cam may include a roller cam body slidably inserted into the cam slot, a cam head rotatably inserted into the second sliding aperture and a protrusion formed to prevent the roller cam from being removed or withdrawn. The roller wheel may include a wheel body slidably connected to the camshaft and a wheel head rotatably inserted into the first sliding aperture. A camshaft oil aperture may be formed within the camshaft along a longitudinal direction thereof, a body oil aperture in communication with the camshaft oil aperture may be formed on the wheel body of the roller wheel and an oil groove in communication with the body oil aperture may be formed on the wheel head of the roller wheel.

The cam unit may include a first cam portion and a second cam portion disposed to correspond to a cylinder and an adjacent cylinder respectively and the inner wheel may include a first inner wheel and a second inner wheel configured to transmit a rotation of the camshaft to the first cam portion and the second cam portion, respectively. The first inner wheel and the second inner wheel may be rotatably connected to each other. The continuous variable valve duration apparatus may further include a bearing disposed within the wheel housing and supporting the first inner wheel and the second inner wheel.

Two cams may be formed on the first cam portion and the second cam portion and a cam connecting portion may be formed between the cams, and the continuous variable valve duration apparatus may further include a cam cap on which a cam supporting portion configured to support the cam connecting portion may be formed. A plurality of journals may be formed on the control shaft and the continuous variable valve duration apparatus may further include a plurality of journal bracket configured to support the plurality of journals.

The journal bracket may be mounted to the cam cap. A journal bracket protrusion may be formed on at least one of the plurality of journal brackets and the continuous variable valve duration apparatus may further include a stopper connected to the control shaft to limit rotation of the control shaft by contacting the journal bracket protrusion. A slider connecting aperture may be formed on the slider, a hinge shaft groove may be formed on the hinge shaft. The continuous variable valve duration apparatus may further include a connecting pin inserted into the connecting aperture and the hinge shaft groove configured to prevent the hinge shaft from being separated. A control shaft aperture into which the control shaft is inserted may be formed on the wheel housing.

An engine according to an exemplary embodiment of the present invention may be provided with the continuous variable valve duration apparatus. As described above, a continuous variable valve duration apparatus according to an exemplary embodiment of the present invention may vary an opening duration of a valve based on operation conditions of an engine, with a simplified construction. The continuous variable valve duration apparatus according to an exemplary embodiment of the present invention may be reduced in size and thus the entire height of a valve train may be reduced. Since the continuous variable valve duration apparatus may be applied to an existing engine without excessive modification, thus productivity may be enhance and production cost may be reduced.

BRIEF DESCRIPTION OF THE DRAWINGS

The objects, features and advantages of the present invention will be more apparent from the following detailed description in conjunction with the accompanying drawings, in which.

DESCRIPTION OF SYMBOLS

Figure 1:
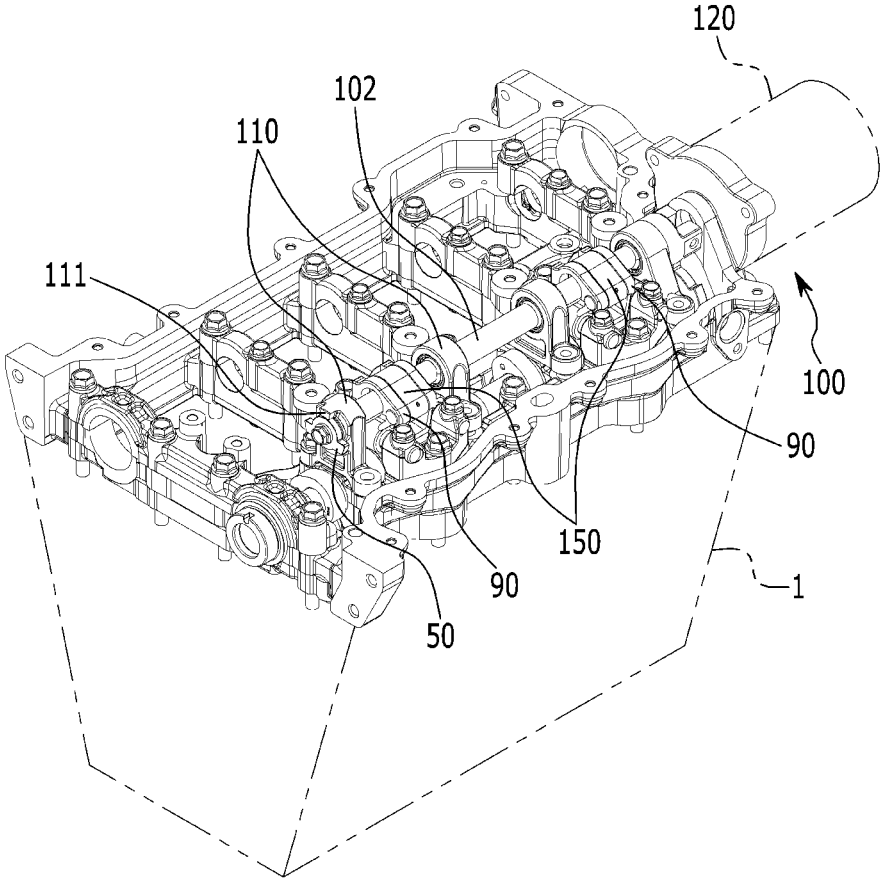
FIG. 1 is a perspective view of an engine provided with a continuous variable valve duration apparatus according to an exemplary embodiment of the present invention.

1: engine
30: camshaft
32: camshaft oil aperture
34: camshaft aperture
40: cam cap
46: cam supporting portion
50: stopper
60: roller wheel
62: wheel body
64: wheel head
66: body oil aperture
68: oil groove
69: communicate aperture
70: cam unit
70*a*, 70*b*: first/second cam portion
71, 72: cam
74: cam slot
76: cam connecting portion
80: inner wheel
82: roller cam
82*a*: roller cam body
82*b*: roller cam head
82*c*: protrusion
83: cam slot
84: first inner wheel connecting portion
85: second inner wheel connecting portion
86: first sliding aperture
88: second sliding aperture
90: wheel housing
92: housing hinge aperture
94: guide aperture
96: control shaft aperture
100: controller
102: control shaft
104: eccentric cam
106: journal
110: journal bracket
111: journal bracket protrusion
112: journal bearing
120: control motor
130: guide portion
132: guide shaft
134: guide bracket
140: bearing
150: slider
152: slider hinge aperture
154: slide control aperture
156: slider connecting aperture
160: hinge shaft
162: hinge shaft groove
164: connecting pin
200: valve
201-204: 1-4 cylinder

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

In the following detailed description, only certain exemplary embodiments of the present invention have been shown and described, simply by way of illustration. As those skilled in the art would realize, the described embodiments may be modified in various different ways, all without departing from the spirit or scope of the present invention. A part irrelevant to the description will be omitted to clearly describe the present invention, and the same or similar elements will be designated by the same reference numerals throughout the specification. In the drawings, the thickness of layers, films, panels, regions, etc., are exaggerated for clarity.

Figure 2:
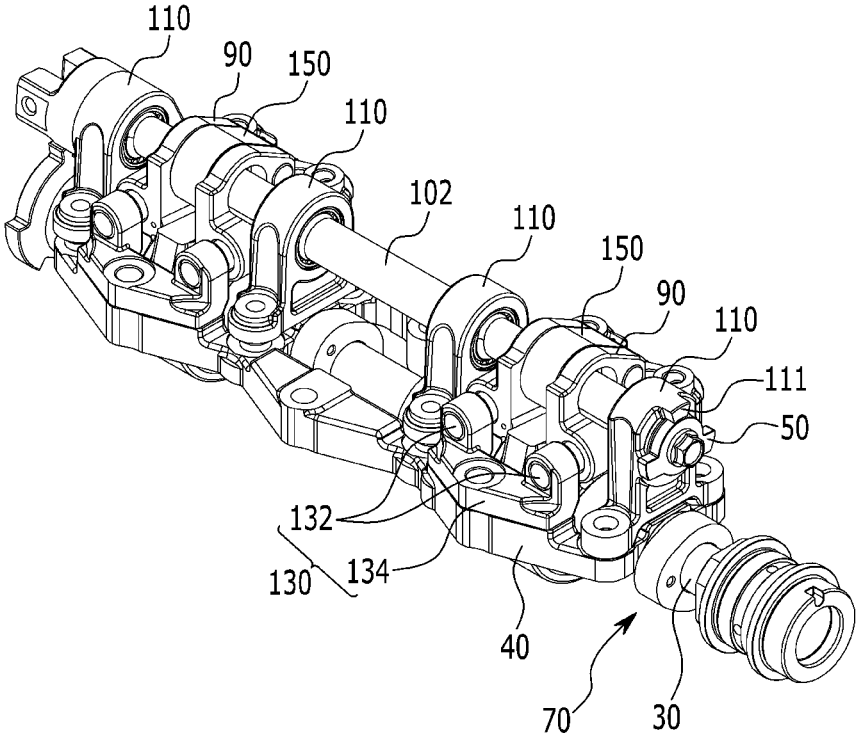
FIG. 2 is a perspective view of a continuous variable valve duration apparatus according to an exemplary embodiment of the present invention.

An exemplary embodiment of the present invention will hereinafter be described in detail with reference to the accompanying drawings. FIG. 1 is a perspective view of an engine provided with a continuous variable valve duration apparatus according to an exemplary embodiment of the present invention and FIG. 2 is a perspective view of a continuous variable valve duration apparatus according to an exemplary embodiment of the present invention.

Figure 3:
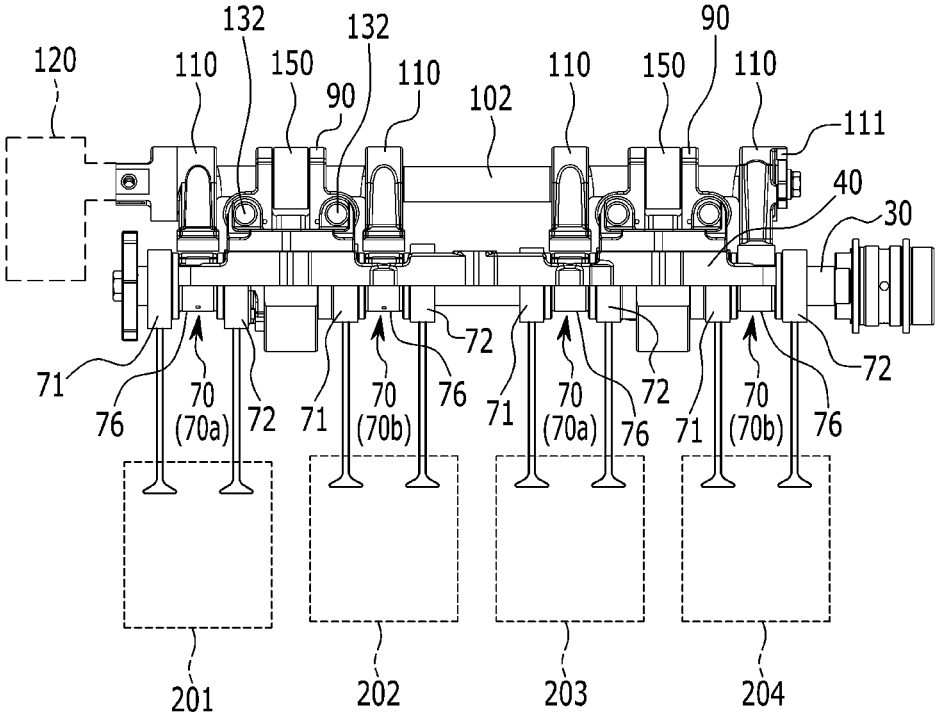
FIG. 3 is a side view of a continuous variable valve duration apparatus according to an exemplary embodiment of the present invention.
Figure 4:
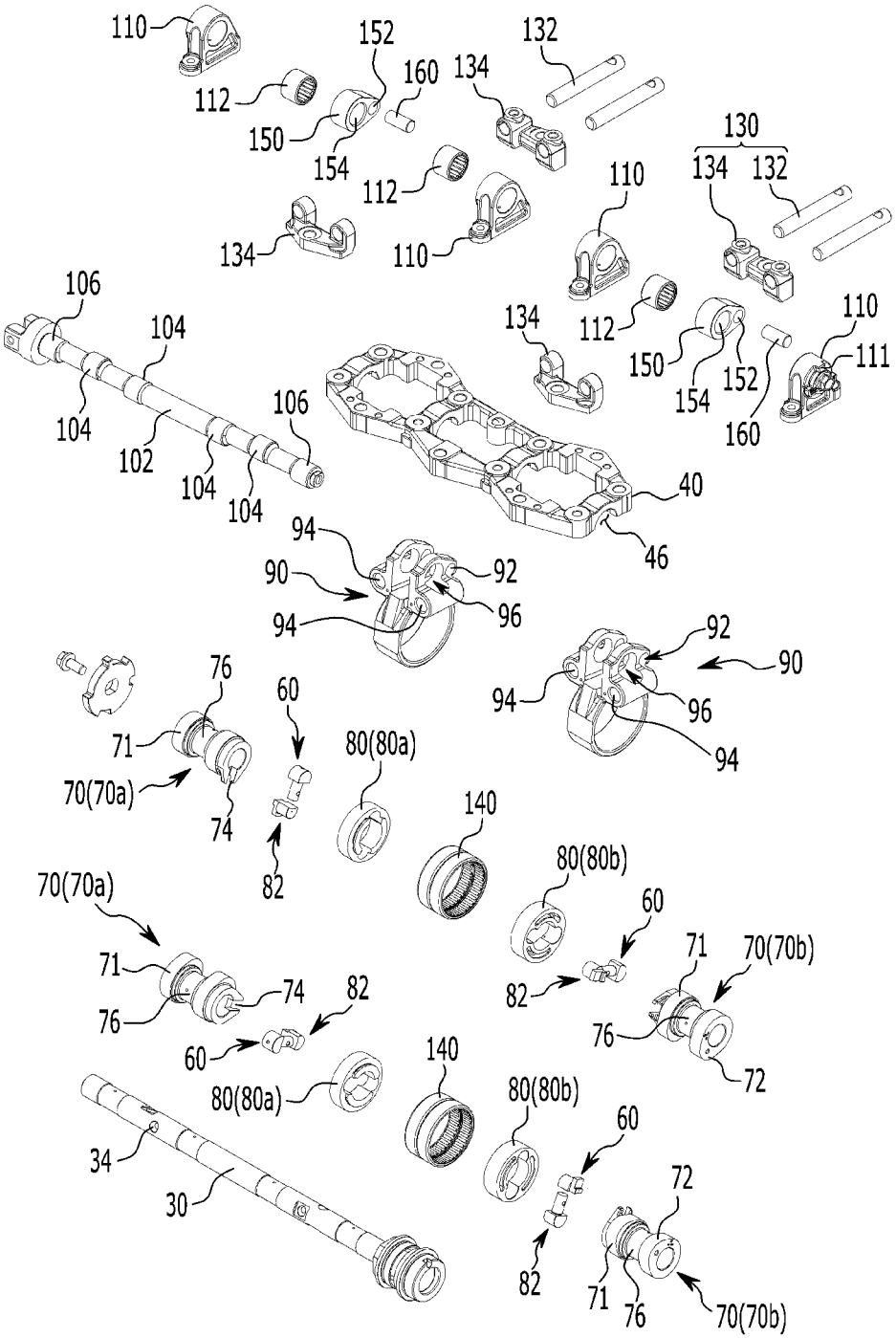
FIG. 4 is a detailed view of a continuous variable valve duration apparatus according to an exemplary embodiment of the present invention.
Figure 5:
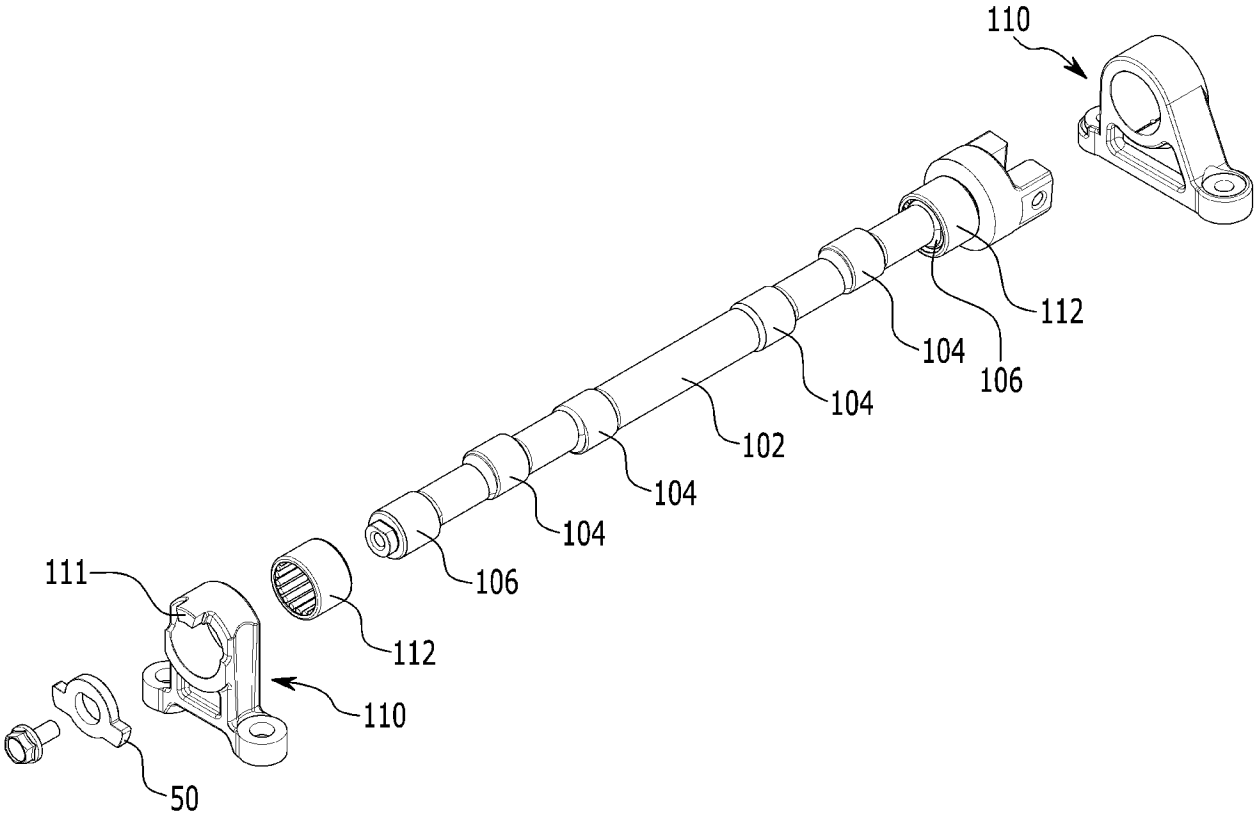
FIG. 5 is a partial detailed view of a continuous variable valve duration apparatus according to an exemplary embodiment of the present invention.
Figure 6:
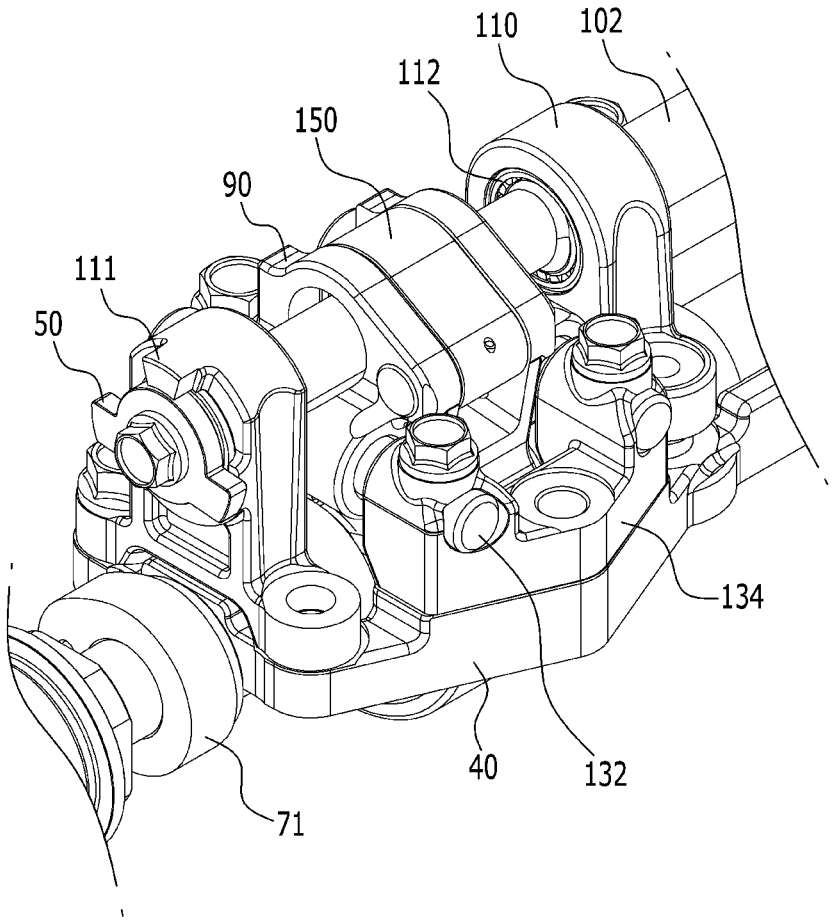
FIG. 6 and FIG. 7 are drawings showing a wheel housing of a continuous variable valve duration apparatus according to an exemplary embodiment of the present invention.
Figure 7:
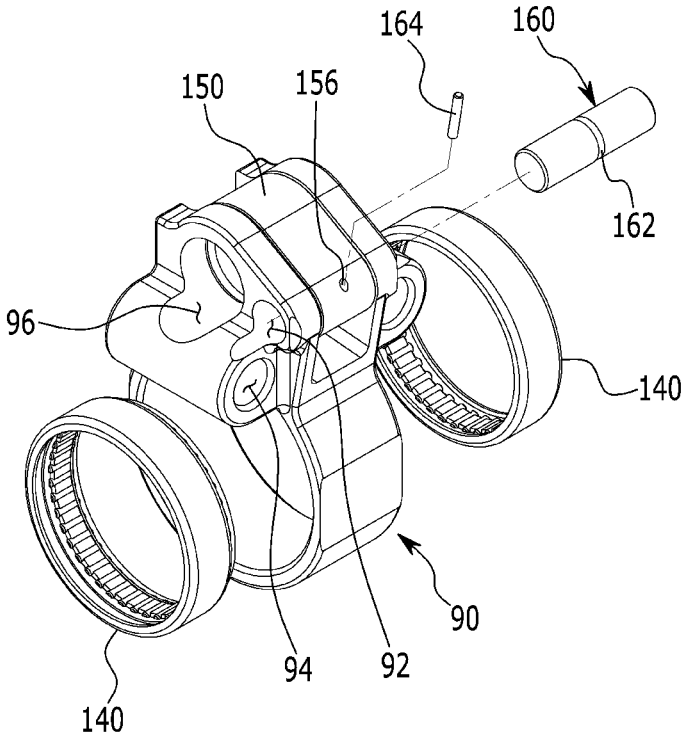

FIG. 3 is a side view of a continuous variable valve duration apparatus according to an exemplary embodiment of the present invention and FIG. 4 is a detailed view of a continuous variable valve duration apparatus according to an exemplary embodiment of the present invention. FIG. 5 is a partial detailed view of a continuous variable valve duration apparatus according to an exemplary embodiment of the present invention and FIG. 6 and FIG. 7 are drawings showing a wheel housing of a continuous variable valve duration apparatus according to an exemplary embodiment of the present invention.

Referring to FIG. 1 to FIG. 7, an engine 1 according to an exemplary embodiment of the present invention includes a continuous variable valve duration apparatus. In the drawings, 4 cylinders 201, 202, 203 and 204 are formed to the engine, but it is not limited thereto.

The continuous variable valve duration apparatus according to an exemplary embodiment of the present invention includes a camshaft 30, a cam unit 70 on which a cam 71 is formed and the camshaft 30 may be inserted into the cam unit 70, an inner wheel 80 configured to transmit rotation of the camshaft 30 to the cam unit 70, a wheel housing 90 in which the inner wheel 80 is rotatably inserted and on which a housing hinge aperture 92 parallel to the camshaft 30 is formed, a slider 150 on which a slider hinge aperture 152 and a slider control aperture 154 parallel to the camshaft 30 are formed, a hinge shaft 160 inserted into the housing hinge aperture 92 and the slider hinge aperture 152, a control shaft 102 on which an eccentric cam 104 inserted into the slider control aperture 154 is formed and a controller 100 configured to selectively rotate the control shaft 102 to move the wheel housing 90 perpendicular to the camshaft 30 via the slider 150.

In particular, a valve duration refers to an opening duration of a valve, that is, a duration from valve opening and to valve closing. The camshaft 30 may be an intake camshaft or an exhaust camshaft. A guide aperture 94 may be formed on the wheel housing 90 perpendicular to the camshaft 30. The continuous variable valve duration apparatus may further include a guide portion 130 having a guide shaft 132 inserted into the guide aperture 94 to guide movement of the wheel housing 90. The guide portion 130 may further include a guide bracket 134 that supports the guide shaft 132. The controller 100 may include a control motor 120 configured to selectively rotate the control shaft 102.

Figure 8:
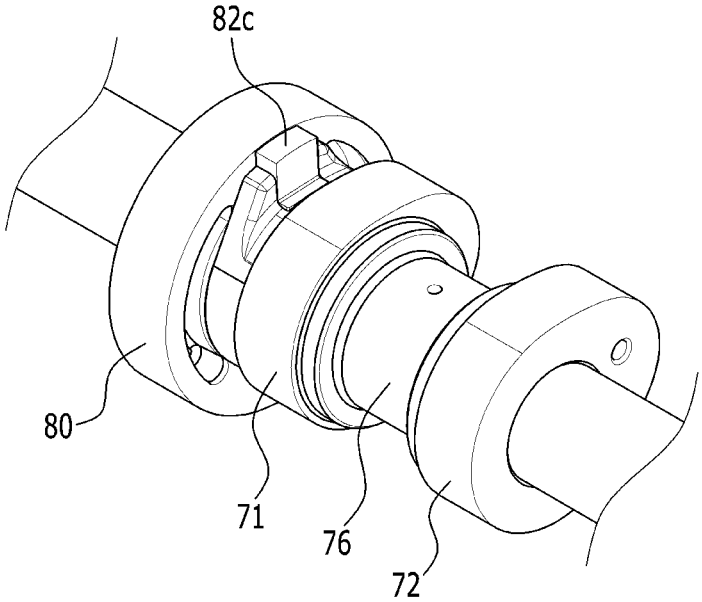
FIG. 8 and FIG. 9 are drawings showing an inner wheel and a cam unit of a continuous variable valve duration apparatus according to an exemplary embodiment of the present invention'
Figure 9:
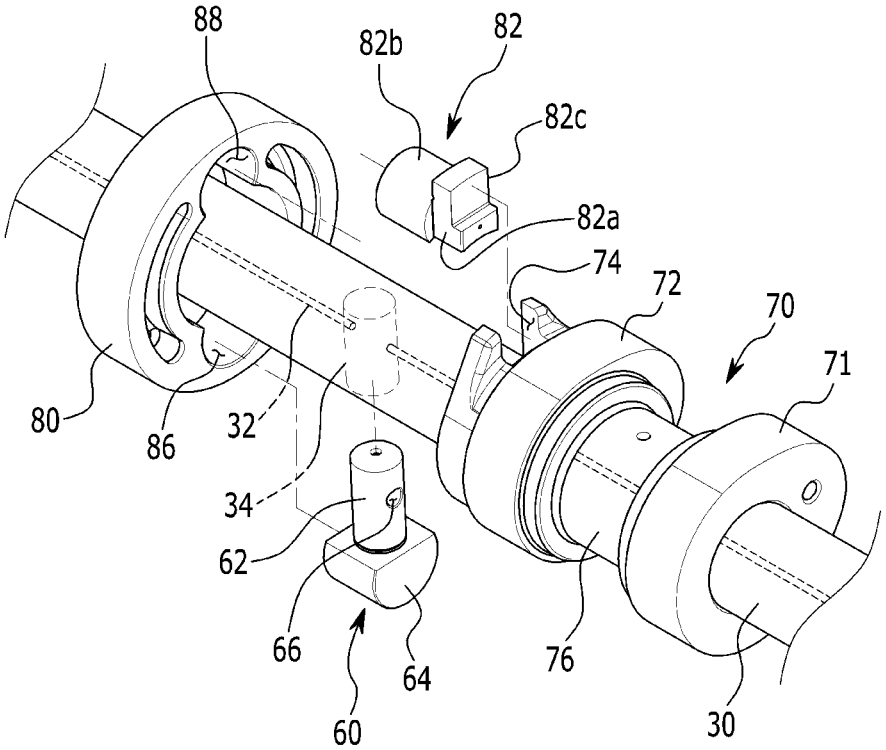
Figure 10A:
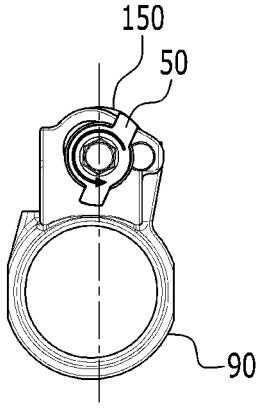
FIGS. 10A-10C are drawings showing a stopper of a continuous variable valve duration apparatus according to an exemplary embodiment of the present invention.
Figure 10B:
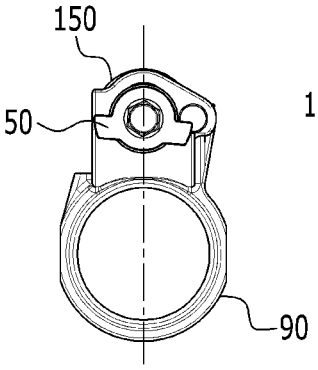
Figure 10C:
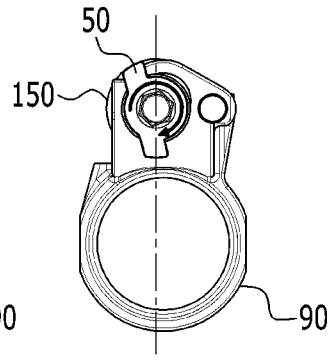
Figure 11:
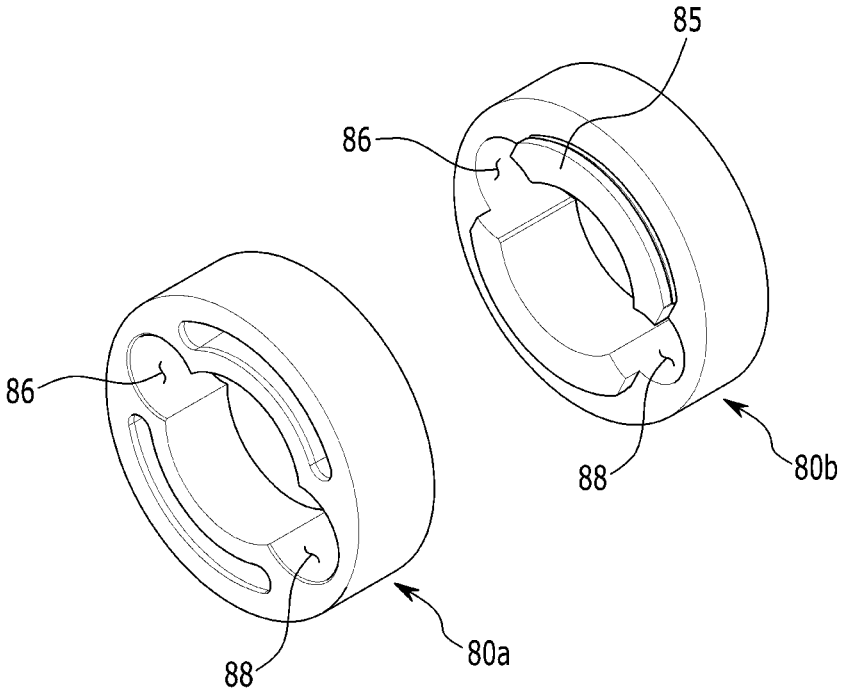
FIG. 11 and FIG. 12 are drawings showing an inner wheel of a continuous variable valve duration apparatus according to an exemplary embodiment of the present invention.
Figure 12:
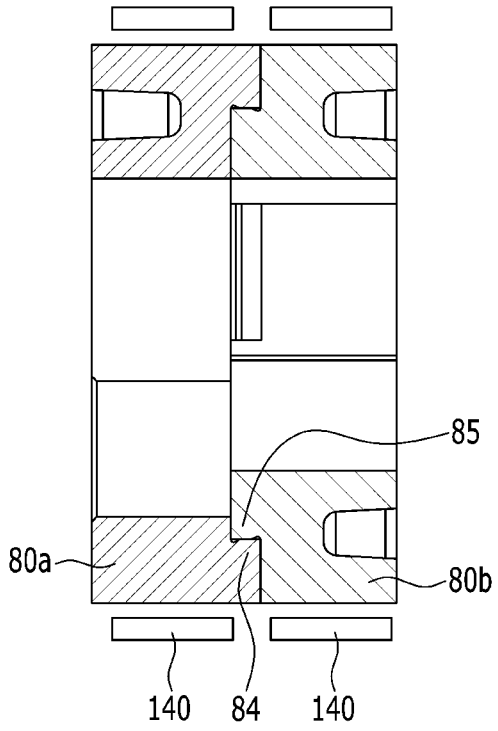

FIG. 8 and FIG. 9 are drawings showing an inner wheel and a cam unit of a continuous variable valve duration apparatus according to an exemplary embodiment of the present invention and FIGS. 10A-10C are drawings showing a stopper of a continuous variable valve duration apparatus according to an exemplary embodiment of the present invention. FIG. 11 and FIG. 12 are drawings showing an inner wheel of a continuous variable valve duration apparatus according to an exemplary embodiment of the present invention.

Referring to FIG. 1 to FIG. 12, a first sliding aperture 86 and a second sliding aperture 88 may be formed through the inner wheel 80 respectively and a cam slot 74 may be formed on the cam unit 70. The continuous variable valve duration apparatus may further include a roller wheel 60 connected to the camshaft 30 and rotatably inserted into the first sliding aperture 86 and a roller cam 82 slidably inserted into the cam slot 74 and rotatably inserted into the second sliding aperture 88. The roller cam 82 may include a roller cam body 82*a* slidably inserted into the cam slot 74 and a cam head 82*b* rotatably inserted into the second sliding aperture 88.

A protrusion 82*c* may be formed on the roller cam 82 to prevent the roller cam 82 from being separated from the inner wheel 80 along the longitudinal direction of the camshaft 30. The roller wheel 60 may include a wheel body 62 slidably connected to the camshaft 30 and a wheel head 64 rotatably inserted into the first sliding aperture 86 and the wheel body 62. The wheel head 64 may be integrally formed.

Additionally, a camshaft aperture 34 may be formed on the camshaft 30, the wheel body 62 of the roller wheel 60 may be movably inserted into the camshaft aperture 34 and the wheel head 64 may be rotatably inserted into the first sliding aperture 86. A camshaft oil aperture 32 may be formed within the camshaft 30 along a longitudinal direction thereof, a body oil aperture 66 in communication with the camshaft oil aperture 32 may be formed on the wheel body 62 of the roller wheel 60 and an oil groove 68 (referring to FIG. 13) in communication with the body oil aperture 66 may be formed to the wheel head 64 of the roller wheel 60.

Lubricant supplied to the camshaft oil aperture 32 may be supplied to the inner wheel 80 through the body oil aperture 66, the communicate aperture 69 and the oil groove 68.

The cam unit 70 may include a first cam portion 70*a* and a second cam portion 70*b* which are disposed to correspond to a cylinder and an adjacent cylinder respectively, for example the first cylinder 201 and the adjacent second cylinder 202 and the inner wheel 80 may include a first inner wheel 80*a* and a second inner wheel 80*b* configured to transmit rotation of the camshaft 30 to the first cam portion 70*a* and the second cam portion 70*b*, respectively.

The continuous variable valve duration apparatus may further include a bearing 140 disposed within the wheel housing 90 for supporting the first inner wheel 80*a* and the second inner wheel 80*b*. The bearing 140 may be a needle bearing, the first and the second inner wheels 80*a* and 80*b* may be disposed within one wheel housing 90 and the bearing 140 may rotatably support the first and the second inner wheels 80*a* and 80*b*. Since the first and the second inner wheels 80*a* and 80*b* may be disposed within one wheel housing 90, the number of overall elements may be reduced, and thus, productivity and manufacturing economy may be enhanced.

The first inner wheel 80*a* and the second inner wheel 80*b* within the wheel housing 90 may be rotatable connected to each other. For example, a first inner wheel connecting portion 84 and a second inner wheel connecting portion 85 may be formed to the first inner wheel 80*a* and the second inner wheel 80*b* respectively, and the first inner wheel connecting portion 84 and the second inner wheel connecting portion 85 may be connected to each other. The drawings show that the first inner wheel connecting portion 84 and the second inner wheel connecting portion 85 are formed as convex and concave elements, however, the present invention it is not limited thereto. The first inner wheel 80*a* and the second inner wheel 80*b* may be rotatably connected to each other with variable connecting structures. When the first inner wheel 80*a* and the second inner wheel 80*b* are connected, looseness or vibration due to manufacturing tolerances of the bearing, the inner wheel, the lifter and on the like may be reduced.

Two cams 71 and 72 may be formed on the first and the second cam portions 70*a* and 70*b* as a pair and a cam cap connecting portion 76 may be formed between the paired cams 71 and 72 of each of the first and second cam portions 70*a* and 70*b*. The cam 71 and 72 may be configured to rotate to thus open the valve 200. The continuously variable valve timing apparatus may further include a cam cap 40 on which a cam supporting portion 46 configured to rotatably support the cam cap connecting portion 76 is formed on the cam cap 40. The guide bracket 134 may be connected to the cam cap 40 which rotatably supports the cam unit 70 where the cam connecting portion 76 is formed.

A plurality of journals 106 may be formed on the control shaft 102 and the continuous variable valve duration apparatus may further include a plurality of journal bracket 110 configured to support the plurality of journals 106. Since the journal bracket 110 may be mounted to the cam cap 40, assembly and maintenance may be performed more easily. A journal bracket protrusion 111 may be formed on at least one of the plurality of journal brackets 110 and a stopper 50 may be connected to the control shaft 102 to limit rotation of the control shaft 102 by contacting the journal bracket protrusion 111.

A slider connecting aperture 156 may be formed through the slider 150, a hinge shaft groove 162 may be formed on the hinge shaft 160 and a connecting pin 164 may be inserted into the connecting aperture 156 and the hinge shaft groove 162 configured to prevent the hinge shaft 160 from being separated. A control shaft aperture 96 into which the control shaft 102 is inserted may be formed through the wheel housing 90.

Figure 13:
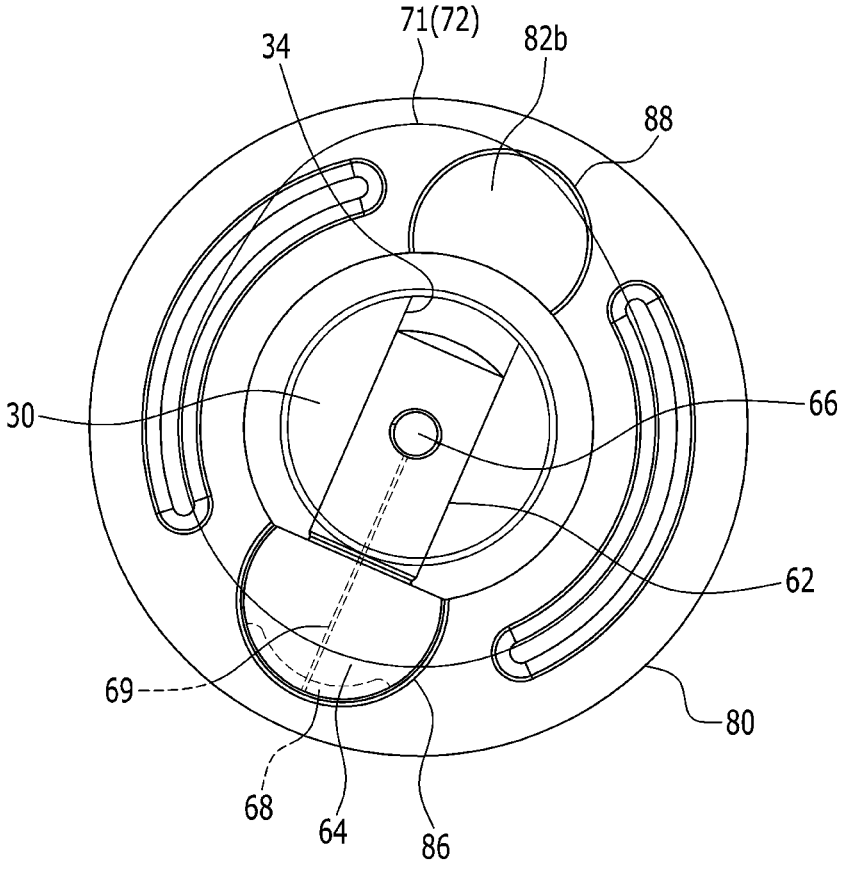
FIG. 13 to FIG. 15 are drawings showing operations of an inner wheel of a continuous variable valve duration apparatus according to an exemplary embodiment of the present invention.
Figure 14:
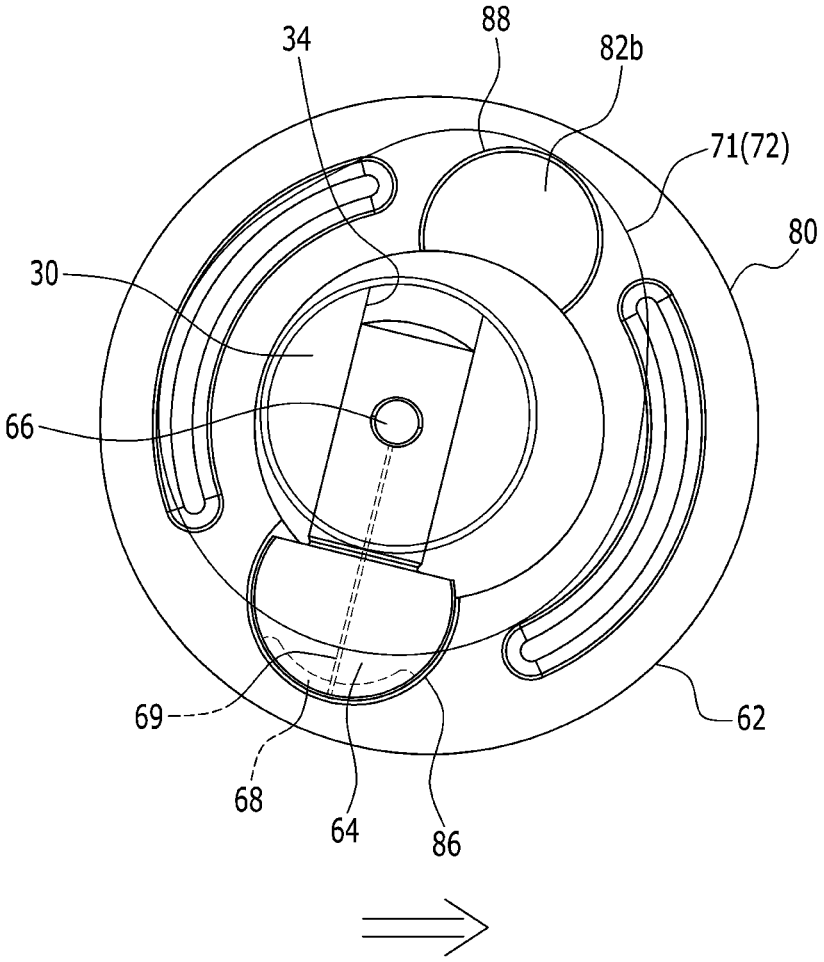
Figure 15:
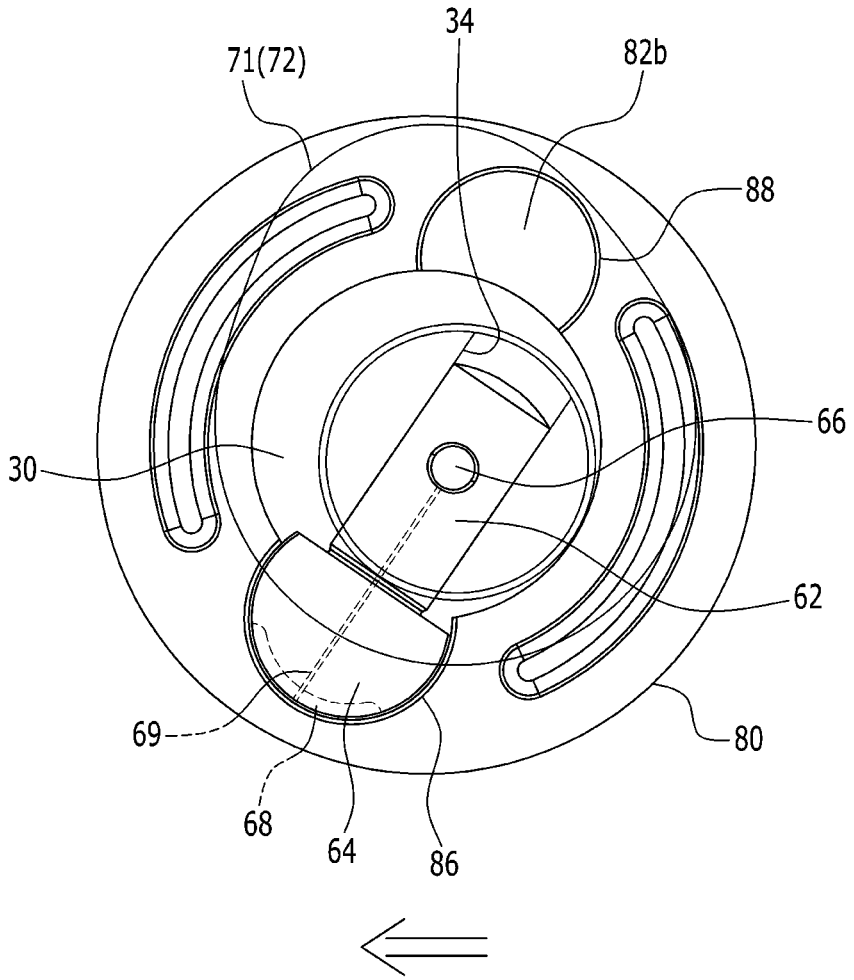
Figure 16:
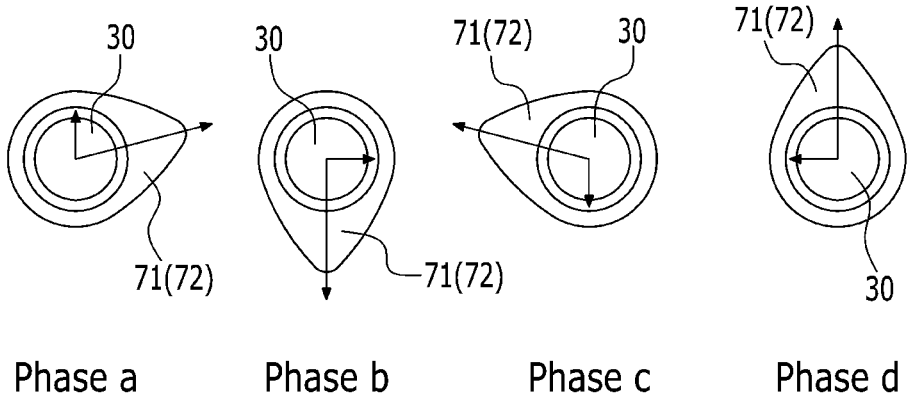
FIG. 16 and FIG. 17 are drawings showing operations of a continuous variable valve duration apparatus according to an exemplary embodiment of the present invention.
Figure 17:
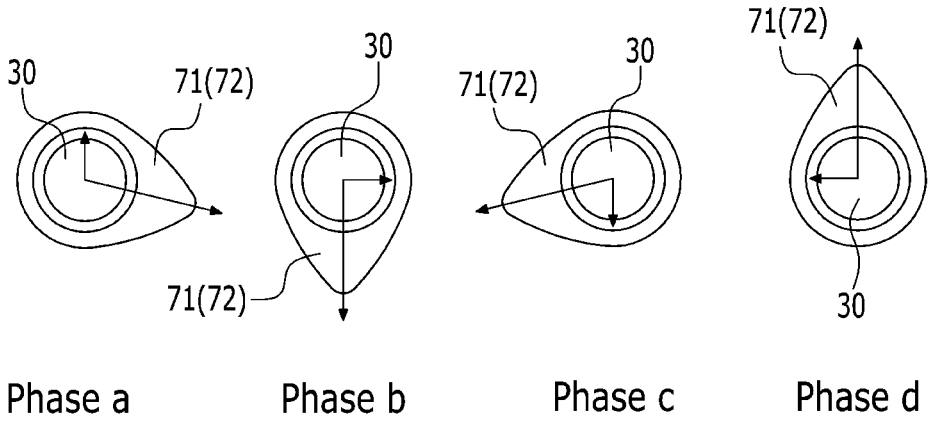

FIG. 13 to FIG. 15 are drawings showing operations of an inner wheel of a continuous variable valve duration apparatus according to an exemplary embodiment of the present invention and FIG. 16 and FIG. 17 are drawings showing operations of a continuous variable valve duration apparatus according to an exemplary embodiment of the present invention. As shown in FIG. 10B and FIG. 13, when rotation centers of the camshaft 30 and the cam unit 70 are coincident, the cams 71 and 72 rotate with the same phase angle of the camshaft 30. According to engine operation states, an ECU (engine control unit or electric control unit) may be configured to transmit control signals to the control portion 100, and then the control motor 120 may be configured to rotate the control shaft 102.

Further, the slider 150 connected with the eccentric cam 104 via the slider control aperture 154 may push or pull the wheel housing 90 to move the wheel housing 90 along the guide shaft 132. As shown in FIG. 10A or FIG. 10B, FIG. 14 and FIG. 15, a relative position of the wheel housing 90 with respect to the camshaft 30 may be changed due to rotation of the control shaft 102. When the relative position of the wheel housing 90 with respect to the camshaft 30 is changed, the relative rotation speed of the cams 71 and 72 with respect to the rotation speed of the camshaft 30 may be changed.

While the slider pin 60 is rotated together with the camshaft 30, the pin body 62 may be slidable within the camshaft aperture 34, the pin head 64 may be rotatable within the first sliding aperture 86, and the roller cam 82 may be rotatable within the second sliding aperture 88 and slidable within the cam slot 74. Thus, the relative rotation speed of the cams 71 and 72 with respect to the rotation speed of the camshaft 30 may be changed.

When the rotation center of the wheel housing 90 with respect to the camshaft 30 moves to one direction (e.g., a first direction), the rotation speed of the cams 71 and 72 are faster than rotation speed of the camshaft 30 from phase a to phase b and from phase b to phase c, then the rotation speed of the cams 71 and 72 are slower than rotation speed of the camshaft 30 from phase c to phase d and from phase d to phase a as shown in FIG. 16. When the rotation center of the wheel housing 90 with respect to the camshaft 30 moves to an opposite direction (e.g., a second direction opposite to the first direction), the rotation speed of the cams 71 and 72 are slower than rotation speed of the camshaft 30 from phase a to phase b and from phase b to phase c, then the rotation speed of the cams 71 and 72 are faster than rotation speed of the camshaft 30 from phase c to phase d and from phase d to phase a as shown in FIG. 17.

Figure 18A:
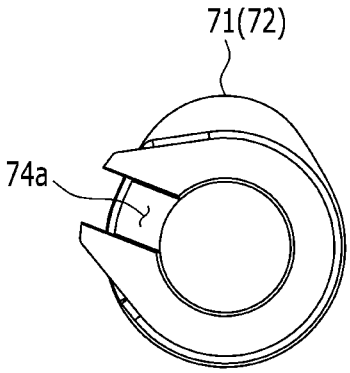
FIGS. 18A-18B are drawings showing a cam slot of a continuous variable valve duration apparatus according to an exemplary embodiment of the present invention.
Figure 18B:
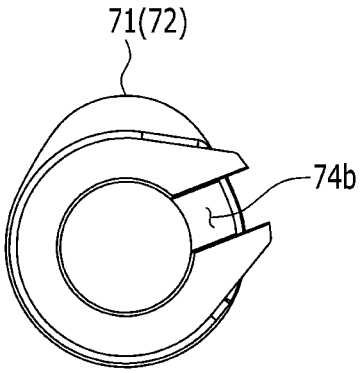
Figure 19A:
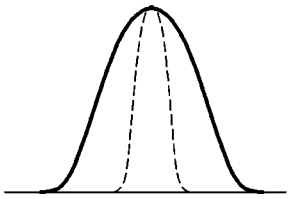
FIGS. 19A-19C are graphs showing valve profile of a continuous variable valve duration apparatus according to an exemplary embodiment of the present invention.
Figure 19B:
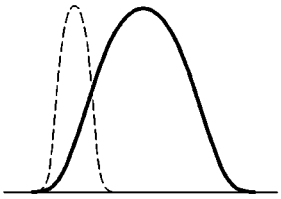
Figure 19C:
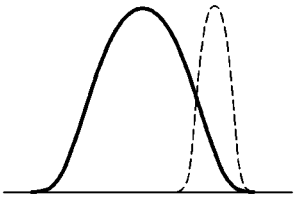

FIGS. 18A-18B are drawings showing a cam slot of a continuous variable valve duration apparatus according to an exemplary embodiment of the present invention and FIGS. 19A-19C are graphs showing valve profile of a continuous variable valve duration apparatus according to an exemplary embodiment of the present invention. As shown in FIGS. 18A-18B, the cam slot 74 may be formed more retarded than a position of the cam 71 or 72 (referring to (74*a*) of FIGS. 18A-18B) or the cam slot 74 may be formed more advanced than a position of the cam 71 or 72 (referring to (74*b*) of FIGS. 18A-18B), or the cam slot 74 may be formed with the same phase of the cam 71 or 72. With the above configuration, various valve profiles may be achieved. Although maximum lift of the valve 200 is constant, however rotation speed of the cam 71 and 72 with respect to the rotation speed of the camshaft 30 may be changed according to relative positions of the slider housing 90 to thus change the closing and opening time of the valve 200. In other words, duration of the valve 200 may be changed.

According to the relative position of the cam slot 74, mounting angle of the valve 200 and on the like, opening and closing time of the valve may be simultaneously changed as shown in FIG. 19A. While opening time of the valve 200 is constant, closing time of the valve 200 may be retarded or advanced as shown in FIG. 19B. While closing time of the valve 200 is constant, opening time of the valve 200 may be retarded or advanced as shown in FIG. 19C.

As described above, a continuous variable valve duration apparatus according to an exemplary embodiment of the present invention may achieve various valve duration with a simplified configuration. The continuous variable valve duration apparatus according to an exemplary embodiment of the present invention may be reduced in size and thus the entire height of a valve train may be reduced. Since the continuous variable valve duration apparatus may be applied to an existing engine without excessive modification, productivity may be enhanced and production cost may be reduced.

While this invention has been described in connection with what is presently considered to be practical exemplary embodiments, it is to be understood that the invention is not limited to the disclosed exemplary embodiments. On the contrary, it is intended to cover various modifications and equivalent arrangements included within the spirit and scope of the appended claims.

What is claimed is:

1. A continuous variable valve duration apparatus, comprising:

a camshaft;

a cam unit on which a cam is formed, wherein the camshaft is inserted into the cam unit;

an inner wheel configured to transmit rotation of the camshaft to the cam unit;

a wheel housing in which the inner wheel is rotatably inserted and through which a housing hinge aperture parallel to the camshaft is formed;

a slider through which a slider hinge aperture and a slider control aperture parallel to the camshaft are formed;

a hinge shaft inserted into the housing hinge aperture and the slider hinge aperture;

a control shaft on which an eccentric cam inserted into the slider control aperture is formed; and a controller configured to selectively rotate the control shaft to move the wheel housing perpendicular to the camshaft via the slider.

2. The continuous variable valve duration apparatus of claim 1, further comprising:

a guide aperture formed through the wheel housing perpendicular to the camshaft; and a guide portion having a guide shaft inserted into the guide aperture to guide movement of the wheel housing.

3. The continuous variable valve duration apparatus of claim 2, wherein the guide portion includes a guide bracket that supports the guide shaft.

4. The continuous variable valve duration apparatus of claim 1, further comprising:

a first sliding aperture and a second sliding aperture formed through the inner wheel respectively;

a cam slot formed on the cam;

a roller wheel connected to the camshaft and rotatably inserted into the first sliding aperture; and a roller cam slidably inserted into the cam slot and rotatably inserted into the second sliding aperture.

5. The continuous variable valve duration apparatus of claim 4, wherein the roller cam includes:

a roller cam body slidably inserted into the cam slot;

a cam head rotatably inserted into the second sliding aperture; and a protrusion formed to prevent the roller cam from being withdrawn.

6. The continuous variable valve duration apparatus of claim 4, wherein the roller wheel includes:

a wheel body slidably connected to the camshaft; and a wheel head rotatably inserted into the first sliding aperture.

7. The continuous variable valve duration apparatus of claim 6, further comprising:

a camshaft oil aperture formed within the camshaft along a longitudinal direction thereof;

a body oil aperture in communication with the camshaft oil aperture formed through the wheel body of the roller wheel; and an oil groove in communication with the body oil aperture formed on the wheel head of the roller wheel.

8. The continuous variable valve duration apparatus of claim 1, wherein:

the cam unit includes a first cam portion and a second cam portion which are disposed to correspond to a cylinder and an adjacent cylinder respectively, and the inner wheel includes a first inner wheel and a second inner wheel configured to transmit a rotation of the camshaft to the first cam portion and the second cam portion respectively.

9. The continuous variable valve duration apparatus of claim 8, wherein the first inner wheel and the second inner wheel are rotatably connected to each other.

10. The continuous variable valve duration apparatus of claim 9, further comprising:

a bearing disposed within the wheel housing and supporting the first inner wheel and the second inner wheel.

11. The continuous variable valve duration apparatus of claim 9, further comprising:

two cams formed on the first cam portion and the second cam portion;

a cam connecting portion formed between the cams; and a cam cap on which a cam supporting portion supporting the cam connecting portion is formed.

12. The continuous variable valve duration apparatus of claim 11, further comprising:

a plurality of journals formed on the control shaft; and a plurality of journal brackets configured to support the plurality of journals.

13. The continuous variable valve duration apparatus of claim 12, wherein the journal brackets are mounted to the cam cap.

14. The continuous variable valve duration apparatus of claim 12, further comprising:

a journal bracket protrusion formed on at least one of the plurality of journal brackets; and a stopper connected to the control shaft and configured to limit rotation of the control shaft by contacting the journal bracket protrusion.

15. The continuous variable valve duration apparatus of claim 1, further comprising:

a slider connecting aperture formed through the slider;

a hinge shaft groove formed on the hinge shaft; and a connecting pin inserted into the connecting aperture and the hinge shaft groove configured to prevent the hinge shaft from being separated.

16. The continuous variable valve duration apparatus of claim 1, wherein a control shaft aperture into which the control shaft is inserted is formed to the wheel housing.

17. An engine provided with the continuous variable valve duration apparatus of claim 1.

* * * * *